US006918788B2

(12) United States Patent
Cavanaugh

(10) Patent No.: US 6,918,788 B2
(45) Date of Patent: Jul. 19, 2005

(54) FIELD-ATTACHABLE DISCONNECTABLE ELECTRICAL CONNECTOR

(76) Inventor: Thomas Harold Cavanaugh, 4375 Goodson Way, Rohnert Park, CA (US) 94928

( * ) Notice: Subject to any disclaimer, the term of this patent is extended or adjusted under 35 U.S.C. 154(b) by 41 days.

(21) Appl. No.: 10/623,876

(22) Filed: Jul. 21, 2003

(65) Prior Publication Data

US 2005/0020130 A1 Jan. 27, 2005

(51) Int. Cl.[7] ..... H01R 13/40
(52) U.S. Cl. ..... 439/587
(58) Field of Search ..... 439/578–585, 439/587, 597, 589, 271, 276, 471, 462, 607–610, 320, 274, 275, 277, 279; 174/59, 81

(56) References Cited

U.S. PATENT DOCUMENTS 3,675,184 A * 7/1972 Vetter ..... 439/462
4,305,636 A * 12/1981 Jackson et al. ..... 439/204
5,267,877 A * 12/1993 Scannelli et al. ..... 439/584
5,439,386 A * 8/1995 Ellis et al. ..... 439/322
5,458,507 A * 10/1995 Colescott et al. ..... 439/589
5,653,615 A * 8/1997 Inaba et al. ..... 439/827
6,142,805 A * 11/2000 Gray et al. ..... 439/206
6,485,335 B1 * 11/2002 Dewdney ..... 439/610

* cited by examiner

*Primary Examiner*—Alex Gilman
(74) *Attorney, Agent, or Firm*—Risto A. Rinne, Jr.

(57) ABSTRACT

An apparatus and method for field attaching an electrical connector to an MC-HL type of cable includes a housing having a built-in ninety degree radius. The housing includes sockets at each end, one for attachment to an oil field wellhead, for example, and the other end to the MC-HL cable. Various component parts are described along with both audible and visual verification that proper attachment has occurred. A method of securing the cable to the connector to provide the required strain relief and not damage the metal cladding is disclosed.

16 Claims, 12 Drawing Sheets

FIELD-ATTACHABLE DISCONNECTABLE ELECTRICAL CONNECTOR

BACKGROUND OF THE INVENTION

1. Field of the Invention

The present invention, in general relates to electrical connectors and, more particularly, to a type of electrical connector that utilizes a type MC-HL class of cable.

The MC-HL designation refers to metal clad hazardous location. MC-HL cable is typically round and includes a plurality of conductors. The MC-HL standard is defined under two Underwriters Laboratory, hereinafter referred to as "UL" specifications. The first includes UL 1569 and is entitled "Metal-Clad Cables" and the second is UL 2225 and is entitled "Metal Clad Cables and Cable-Sealing Fittings for Use in Hazardous (Classified) Locations". The instant invention is applicable for use with all situations that fall under these two UL standards.

The preferred embodiment includes three conductors (and a ground path) that are able to carry 160 amperes at five kilovolts potential for use in hazardous locations. One such common location is to supply electrical power to an oil field wellhead. A submersible pump is commonly disposed within such an oil well. These types of cables include an armor clad exterior surrounded, typically, by a protective jacket coating.

Prior art use of an MC-HL cable includes a factory cut length of the cable that includes a desired radius and is terminated (at the factory) with the necessary connector for an electrical connection to the wellhead. Due to many heretofore unresolved issues and problems, there has been no way to cut a length of MC-HL cable in the field and attach it satisfactorily to an electrical connector that meets necessary specifications for use in hazardous locations.

Yet there remains a great need for such a field-attachable type of connector to the cable. These cables are exceedingly large and heavy. At present, when one is needed, the length of run must be carefully measured, the cable is then ordered from a manufacturer who cuts the cable to length and then attaches the connector(s) to it and then ships the completed code compliant cable assembly to the end-user.

An error in measuring the length, for example, or a change in plans requiring a longer length can delay use of a particular oil well for an extended period of time. Similarly, if a different length is needed for any reason, for example to traverse a different distance, then a new factory prepared cable must be ordered, built, and shipped. This takes time and is especially expensive.

It is not uncommon for such a cable to include a length of up to one thousand feet. Shipping such a length of heavy cable is expensive. If an existing cable is damaged by heavy equipment, for example, it too must be replaced. During such an interval, the oil well remains inoperative, which adversely affects profitability.

The manufacturer who presently provides such a product to the end user typically manufactures the connector for use with the oil wellhead, buys the cable from a cable manufacturer, cuts the cable, adds the connector(s), and then ships the finished product to the end user. This is because typically only the connector manufacturer that manufactures an electrical connector assembly that complies with NEC specifications has the knowledge and the means necessary to the attach the electrical connector to it while maintaining compliance.

As a result, shipping expense for the cable is incurred twice, once to ship the cable to the connector manufacturer from the cable manufacturer and then again to ship the finished cable to the end user.

Clearly, if the cable could be shipped only once, from the cable manufacturer to the end user that would save considerable time and shipping expense. Additionally, if the cable could be shipped in bulk lengths directly to the end user, that would result in the cable being less expensive per foot length. Finally, if that were possible, the end user would have sufficient bulk length cable for whatever tasks or repairs were to occur. However, there has not been any satisfactory method of attaching an electrical connector to the cable by the end user that can be attached in the field, by anyone, even by factory personnel who work for the connector manufacturer that, after attachment, complies with the NEC specifications.

Accordingly, it is desirable to be able to ship to the end user the cable purchased in bulk lengths and to ship separately a vastly smaller, lighter, field-attachable, disconnectable, electrical connector from the connector manufacturer for field-attachment to the cable and thereby provide the end user with versatility and the repair capability of being able to create a functioning code compliant cable with connector(s) within a few hours, and to reap substantial cost savings as a result.

Many end users would prefer to purchase the cable in bulk rolls that are shipped where the oil wells are located, for example, and then assemble the cables on demand at the site. This could decrease down time, would decrease cost, and add versatility to meet the changing needs of the end user. However, for various reasons, this has not been possible heretofore.

These reasons relate primarily to three areas involving attaching a connector to the cable, the first being issues affecting strength and other mechanical considerations, the second being issues that relate to sealing the cable to the connector, and the third being field installation issues. All of these issues must be satisfied with a high degree of certainty.

These cables are used in hazardous locations. For example, noxious and explosive gases may exist in and around the oil well. These gases, preferably, are prevented from entering into the cable and, if they do enter, they must be prevented from escaping at other than at controlled locations, where a proper vent area or vent box is provided. These gases may be under pressure, are hazardous to inhale, even deadly if inhaled in sufficient concentration, and either flammable or explosive if ignited.

It is clear then that the cable must include a sealed interface with any electrical connector that it is attached to and the resultant functionality must meet the necessary electrical code requirements for explosion-proof class of cables.

Mechanical and Strength Issues. It is necessary to ensure that the electrical cable includes sufficient strain relief so that it cannot be pulled out of the connector and dislodged. It must also maintain the necessary strength to prevent dislodging a connector pin or conductor from the pin, or pulling of the cable out of the connector, yet it must ensure that the cable and its armor are not damaged during assembly. The assembled connector must be sufficiently rugged and durable. It is also an added bonus if it can be aesthetically attractive, that is, the finished product should have the look and feel of a high-quality, durable, and professionally assembled product.

Sealing Issues. The cable must be sealed to prevent the introduction of ambient moisture. It must also be sealed sufficient to prevent the leakage of hazardous gas. It must also include sufficient internal electrical characteristics to prevent creepage, a phenomenon where an electrical arc can occur within the connector itself along a substantially linear path over a dielectric.

Field-attachable issues. Assembly must be foolproof so that it is done right the first time, even by potentially unskilled and unfamiliar labor. There must be clear instructions that, if not followed, provide a clear indication of a failure. This is especially important because it would be most hazardous if a connector were improperly attached to the cable and this was not detected, thereby resulting in use of the cable and eventual failure, perhaps in a catastrophic manner. Also, all of the above mechanical and sealing issues must also be satisfied in the field. And, the finished connector must be attachable at a 90 degree angle with respect to a longitudinal length of the cable in order to secure the connector to a mating connector half disposed on top of the wellhead. The cable will be substantially disposed along a horizontal attitude during its run and yet is must interface with the vertical mating connector at the wellhead. Adapting a heavy stiff horizontal run of MC-HL cable to mate with the vertical mating connector at the wellhead is also a mechanical issue and this issue could have been equally well included in either or in both categories.

Adding to the complexity of the problem for field-attachment issues is the rigidity of the cable itself. It is extremely difficult to work with, for example, for a field technician to attempt to bend the cable without damaging it so that it includes a radius that is useful in adapting a horizontal run of the cable to eventually mate with a vertical mating connector. Furthermore, such bending adds complexity to determining the proper overall length required for the cable. These nuances are not easily calculated in the field yet they are important considerations nevertheless. Accordingly, for ease of field-attachment one must be required only to determine the linear length of the run of cable that is required and not have to bend or introduce a radius in the MC-HL cable. This would substantially alleviate this area of complexity, yet there has heretofore been no known way of attaching an electrical connector to a horizontally disposed run of the cable that can then mate with the vertical mating connector at the wellhead and also comply with NEC specifications.

Finally, because of the need to service the well and for general access reasons, the assembled cable with connector must be disconnectable from a corresponding mating connector that is attached to the wellhead.

There are other issues as well that must also be overcome for a code compliant field attachable, disconnectable, cable.

Accordingly, there exists today a need for a field-attachable, disconnectable electrical connector for use with MC-HL cable and to provide a method for field-attachment of the connector to the cable.

Clearly, such an apparatus and method would be useful and desirable.

2. Description of Prior Art

Electrical connectors, including field-attachable connectors are, in general, known. However, there are no known field-attachable connectors for use with MC-HL cable that provide the necessary performance requirements and ease of assembly as the instant invention. While the structural arrangements of the above described known types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a field-attachable, disconnectable electrical connector for use with MC-HL cable that is economical to use.

It is also an important object of the invention to provide a field-attachable, disconnectable electrical connector for use with MC-HL cable that is quick to install.

Another object of the invention is to provide a field-attachable, disconnectable electrical connector for use with MC-HL cable that meets the requirements for use in hazardous environments.

Still another object of the invention is to provide a field-attachable, disconnectable electrical connector for use with MC-HL cable that is durable.

Still yet another object of the invention is to provide a field-attachable, disconnectable electrical connector for use with MC-HL cable that includes a quality appearance.

Yet another important object of the invention is to provide a field-attachable, disconnectable electrical connector for use with MC-HL cable that provides assurance during and after assembly that the attachment procedure has been correctly accomplished.

Still yet another important object of the invention is to provide a field-attachable, disconnectable electrical connector for use with MC-HL cable that is adapted for connection to a corresponding mating connector that is vertically disposed.

Still yet a remaining object of the invention is to provide a field-attachable, disconnectable electrical connector for use with MC-HL cable that includes a ninety degree radius within a portion of the connector that changes the longitudinal direction of the conductor path(s) by ninety degrees.

Still yet a first further object of the invention is to provide a field-attachable, disconnectable electrical connector for use with MC-HL cable that includes a built-in ninety degree power pin assembly that changes the longitudinal direction of the conductor path(s) by ninety degrees.

Still yet a second further object of the invention is to provide a field-attachable, disconnectable electrical connector for use with MC-HL cable that provides a method to retain the cable in the connector while ensuring that the cable, or cable armor, are not damaged during assembly.

Still yet an additional further essential object of the invention is to provide a field-attachable, disconnectable electrical connector for use with MC-HL cable that provides a method to retain the cable in the connector while ensuring that a cable armor is not perforated during assembly.

Still yet an additional and important further object of the invention is to provide a field-attachable, disconnectable electrical connector for use with MC-HL cable that provides sufficient strain relief to retain the cable to the connector while ensuring that the cable is not damaged.

Still yet a third further object of the invention is to provide a field-attachable, disconnectable electrical connector for use with MC-HL cable that is suitable for use in a hazardous environment.

Still yet a fourth further object of the invention is to provide a field-attachable, disconnectable electrical connector for use with MC-HL cable that is suitable for use in an explosive environment.

Still yet a fifth further object of the invention is to provide a field-attachable, disconnectable electrical connector for use with MC-HL cable that provides an environmental seal to prevent ambient moisture from entering into the connector.

Still yet a sixth further object of the invention is to provide a field-attachable, disconnectable electrical connector for use with MC-HL cable that prevents electrical arcs from occurring in the connector.

Still yet a seventh further object of the invention is to provide a field-attachable, disconnectable electrical connector for use with MC-HL cable that provides a positive electrical ground connection.

Still yet an eighth further object of the invention is to provide a field-attachable, disconnectable electrical connector for use with MC-HL cable that can be shipped by the connector manufacturer to an end user for field-attachment use by the end user to the cable.

Still yet a ninth further object of the invention is to provide a method for field-attaching a disconnectable electrical connector to an MC-HL cable.

Still yet a tenth further object of the invention is to provide a method for field-attaching a disconnectable electrical connector to an MC-HL cable that includes a ninety degree radius as part of the connector.

Still yet an eleventh further object of the invention is to provide a method for field-attaching a disconnectable electrical connector to an MC-HL cable that includes a predetermined quantity of a substance that is used to fill a void in the connector wherein if either an excess or a lesser quantity than the predetermined quantity is required to fill the void, this is indicative of an error occurring during attachment of the connector to the cable.

Still yet an twelfth further object of the invention is to provide a method for field-attaching a disconnectable electrical connector to an MC-HL cable that includes a predetermined first quantity of an epoxy that is used to fill a first void in the connector and a remaining second quantity of an epoxy that is used to fill a second void in the connector, and wherein if either an excess or a lesser quantity than the predetermined sum of the first and second quantities is required to fill both the first and second voids, this is indicative of an error occurring during attachment of the connector to the cable.

Still yet a thirteenth further object of the invention is to provide a method for field-attaching a disconnectable electrical connector to an MC-HL cable sufficient to use the cable in a matter of hours.

Still yet a fourteenth further object of the invention is to provide a method for field-attaching a disconnectable electrical connector to an MC-HL cable sufficient to use the cable in under four hours, from start to completion.

Still yet a fifteenth further object of the invention is to provide a field-attachable, disconnectable electrical connector for use with MC-HL cable that provides an internal seal with respect to the cable that is sufficient to prevent hazardous gases from escaping out of the connector.

Still yet a sixteenth further object of the invention is to provide a field-attachable, disconnectable electrical connector for use with MC-HL cable that can be used by the connector manufacturer for factory assembly of the connector to the cable.

Still yet a seventeenth further object of the invention is to provide a field-attachable, disconnectable electrical connector for use with MC-HL cable that can be shipped by the connector manufacturer to an end user for field-attachment use by the end user or alternately the same connector can be used by the connector manufacturer for factory assembly of the connector to the cable.

Briefly, a field-attachable, disconnectable electrical connector for use with MC-HL cable that is constructed in accordance with the principles of the present invention has a power pin assembly that includes conductors therein that have a radius that changes their longitudinal axis by ninety degrees. The power pin assembly is in a ninety degree housing that includes a plurality of sockets at an end that is adapted for attachment to a corresponding connector and a plurality of sockets at an opposite end that are adapted to receive a plurality of power contact pins, each of which is first crimped on to a conductor of the cable. The power contact pins are inserted in the sockets at the opposite end where they snap into place and are retained. A ground wire, or plurality of ground wires, are crimped onto a terminal ring that is secured to the ninety degree housing, thereby ensuring an electrical ground with the ninety degree housing. A sealing grommet that was placed over the conductors and a proximate end portion of the cable is then urged into position against the opposite end of the ninety degree housing. A cylindrical backshell that was also placed over the proximate end of the cable is then urged toward the opposite end of the ninety degree housing and is secured thereto by inner threads at a first end thereof. The backshell is tightened as much as is possible using a spanner wrench. A first quantity of epoxy is used as a filler to seal a predetermined first portion of an interior of the assembly. A split armor cable grip is then placed over the cable and adjacent to a tapered opening that is provided at an opposite end of the backshell. A retaining nut that was the second item placed over the proximate end of the cable is then urged toward the connector and is secured to threads at the opposite end of the backshell. As the retaining nut is fully tightened to the backshell it forces the split armor cable grip into the tapered opening a predetermined distance that is sufficient to compress the split armor cable grip over the cable armor clad and secure the split armor cable grip, and therefore the connector, to the armor clad of the cable and yet not damage the cable. This provides the necessary strain relief. A remaining second quantity of the epoxy is used as a filler to seal a predetermined second portion of an interior of the assembly so that the second quantity of epoxy is flush with a rear of the retaining nut. If the assembly procedure was correct and no parts were omitted and no extra parts inserted into the assembly, the first and second quantity of epoxy must fall within a predetermined range of volume, otherwise an error in the assembly procedure is indicated by a substantial excess of remaining epoxy or by a substantial lack of a sufficient volume of epoxy. A section of cold shrink tubing that was the first item placed over the proximate end of the cable is then urged so that one end of the tubing is disposed over a first shoulder of the retaining nut and a remaining portion extends over a portion of the proximate end of the cable. An expanded core is pulled out from an interior of the cold shrink tubing allowing it to progressively compress over a portion of the retaining nut and cable. A lanyard and protective end cap are attached to the cable as is a certification label. This provides a termination to the cable that includes a high-quality appearance and is in compliance with NEC specifications. If desired, the process can be repeated at each end of the cable and, if further desired, the configuration of the connector can be modified at either or each end to adapt to a particular task at hand, thereby solving all problems necessary to provide a field-attachable disconnectable electrical connector for use with MC-HL type of cable.

DETAILED DESCRIPTION OF THE INVENTION

Figure 10A:
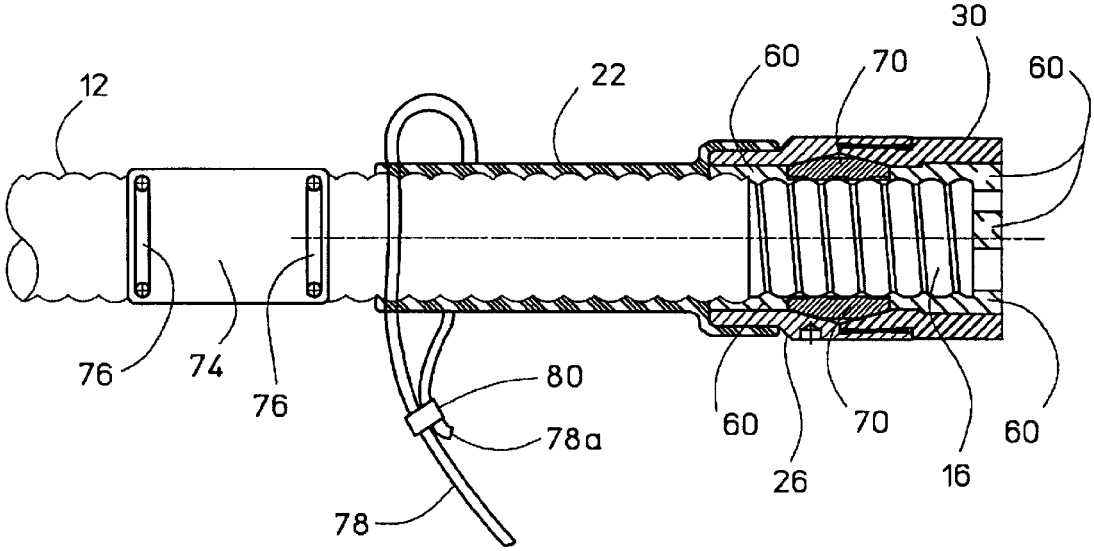
FIG. 10*a* is a cross sectional view of a portion of a field-attachable, disconnectable electrical connector for use with MC-HL cable that has been attached to the cable.
Figure 10B:
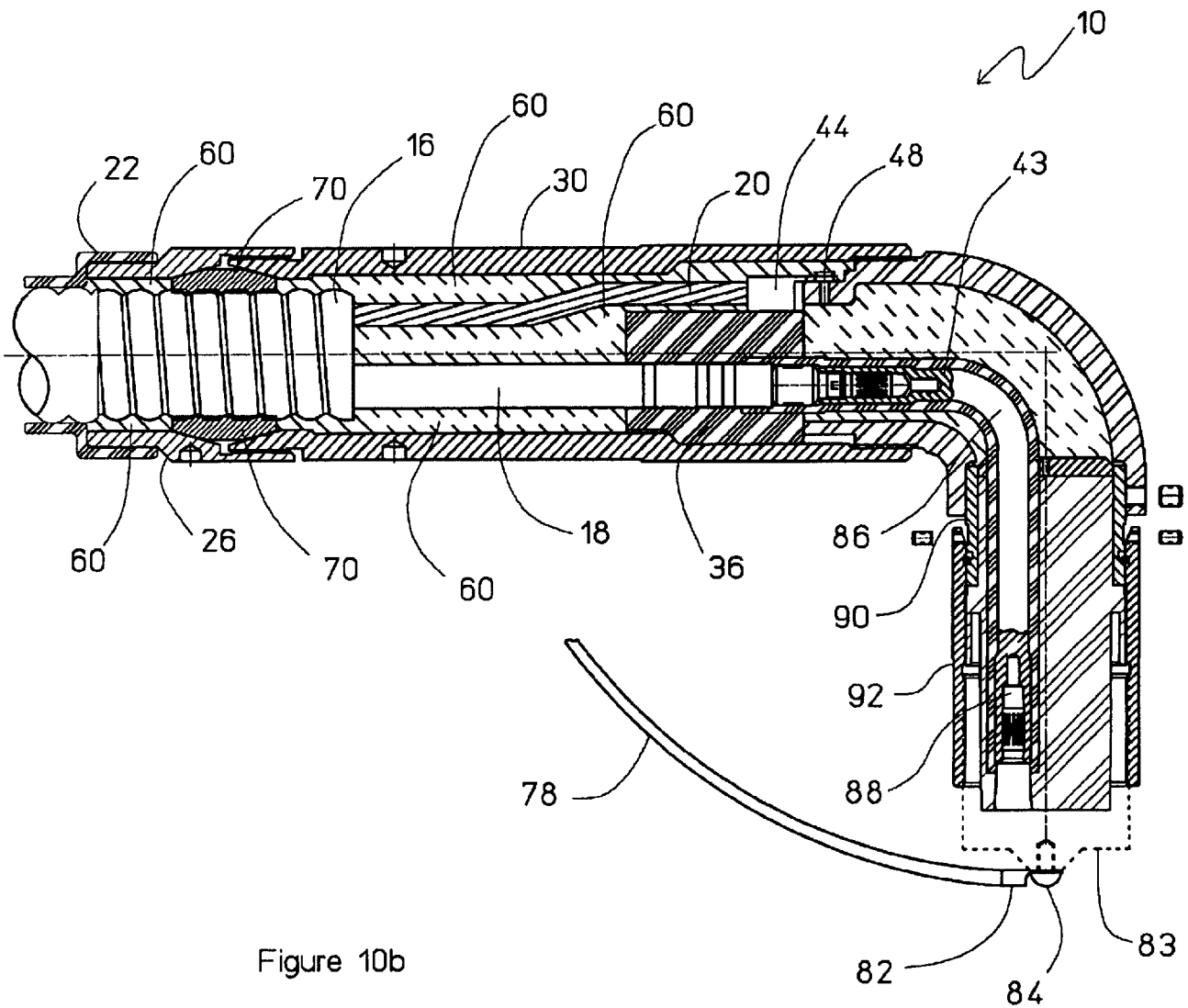
FIG. 10*b* is a cross sectional view of a remaining portion of the field-attachable, disconnectable electrical connector of FIG. 10*a* with a small amount of overlap for clarity.

Referring initially to FIG. 10 is shown a field-attachable, disconnectable electrical connector, identified in general by the reference numeral 10 for use with MC-HL cable 12, the connector 10 being attached to the cable 12.

This shows the field-attachable, disconnectable electrical connector 10 after it has been attached to the cable 12. The process of attaching the connector 10 to the cable 12 is important as are the component parts of the connector 10 because, taken together, the connector 10 can be attached to the cable 12 in the field (at the intended job site) by relatively unskilled labor by following a specific and unique process. A built in fail-safe check ensures that the process (i.e., instructions) have been properly followed, and is described in greater detail hereinafter. It is extremely important that the process of attaching the connector 10 to the cable 12 is properly accomplished, for only then is it possible to ensure attainment of explosion proof class after attachment of the connector 10.

The process of attaching the connector 10 to the cable 12 can also be accomplished by the connector 10 manufacturer at the connector 10 manufacturer's factory and shipped as an already assembled prefabricated product (the sum of components 10 plus 12 form the finished product to an end user.

Accordingly, a first benefit is obtained in that the connector manufacturer can reduce its inventory by use of the connector 10. This is because the connector 10 is used both for shipment to the end user for field attachment to the cable 12 by the end user and also by the connector manufacturer for fabrication of the cable 12 in house. This provides the unexpected benefit of having only one stock assembly component, the connector 10, and of being able to use it as two products.

Using the connector 10 in house to fabricate the finished product (10+12) is appreciated by those customers who, for whatever reason, would prefer not to field-attach the connector 10 to the cable 12 but rather to purchase it as an already assembled finished product. An example of a reason to purchase a finished product instead of fabricate it on site include those types of customers who have less frequent need, perhaps only requiring one or two products per year. Such customers may not wish to avail themselves of the advantages of directly purchasing the cable 12 in bulk.

The description that follows describes the process of field-attachment of the connector 10 to the cable 12 using one FIGURE at a time until the process is complete. This is similar to the instructions that would be provided to the end user. It may be helpful to also refer to FIG. 10 on occasion to see how each step that is described contributes to creation of the finished product.

Figure 1:
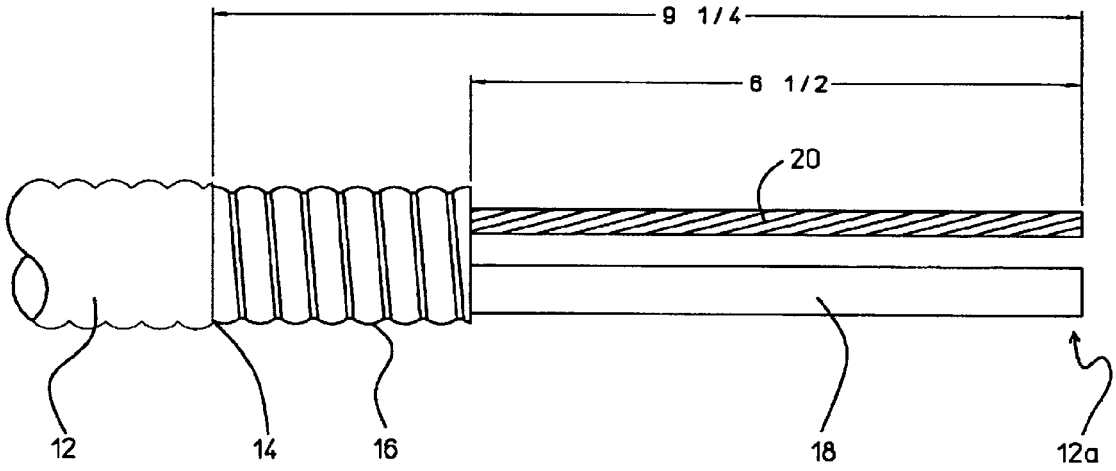
FIG. 1 is a plan view of an initial preparation that is done to the cable.

Referring now in particular now to FIG. 1 on occasion to FIG. 10 and, as desired, to all of the drawings is shown a first end 12*a* of the cable 12 that is being prepared for attachment to the connector 10.

The cable 12 has had a cable jacket 14 cut and removed beginning a distance of nine and one-quarter inches back from the first end 12*a*. An armor clad 16 has been cut and removed beginning a distance of six and one-half inches back from the first end 12*a*. The "cut end" of the armor clad 16 is then rolled over onto itself using a pair of needle nose pliers and a ball peen hammer (not shown) so as to provide an end to the armor clad 16 that will not cut any of three conductors 18 (only one shown in this view) and a ground wire 20.

If the cable 12 is used or weathered, it must be thoroughly cleaned prior to attachment of the connector 10 using an appropriate solvent to clean the cable 12.

Figure 2:
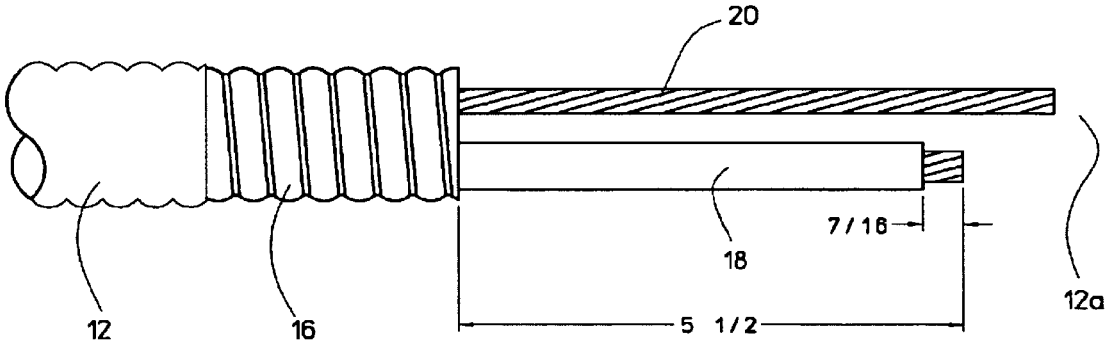
FIG. 2 is a plan view of second preparation that is done to the cable.

Referring now in particular to FIG. 2, each of the three conductors 18 are cut one-inch from the first end 12*a* square and even. The insulation on each of the conductors 18 is cut and removed seven-sixteenths of an inch from the end of each conductor 18. This provides a proper length to each conductor 18 and also the proper length of the ground wire 20 with respect to the conductors 18.

Figure 3:
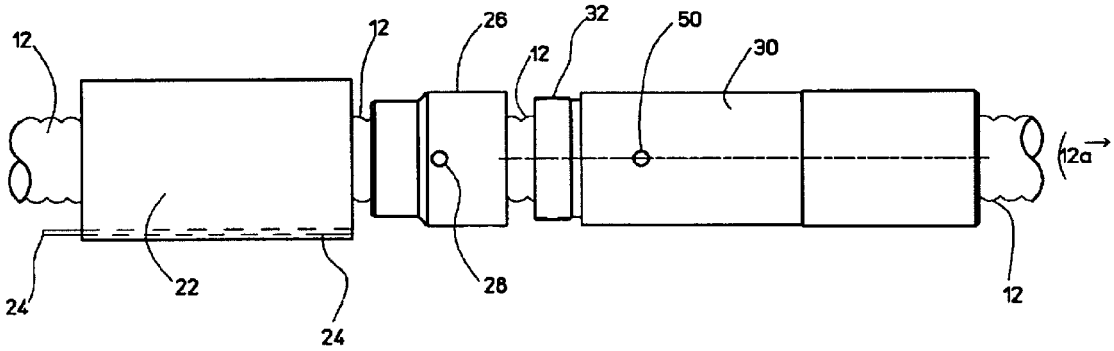
FIG. 3 is a plan view of a sequence of items that are disposed over the cable for later use.

Referring now in particular to FIG. 3 a section of cold shrink tubing 22 is placed over the cable 12 so that a removable core 24 is disposed away from the first end 12*a*. The removable core 24 is a spiral wound core that is pulled out and over the cable 12. As the removable core 24 is pulled, the cold shrink tubing 22 (which is elastomeric) compresses around the cable 12 and portion of the connector 10.

The removable core 24 keeps the tubing 22 from compressing. The end of the removable core 24 that is pulled sequentially unwinds itself beginning at the end opposite to where it is pulled (i.e., the end closest to the first end 12*a* of the cable 12). This is accomplished later and is described in additional detail hereinafter.

A retaining nut 26 is then urged over the cable 12 so that internal threads of the retaining nut 26 are disposed toward the first end 12*a*.

The retaining nut 26 includes a recess 28 or plurality thereof that are provided along its outer circumference. The recess(es) 28 do not pass all the way through the retaining nut 26. A spanner wrench (not shown) is provided and is used to tighten the retaining nut 26 by engaging with the recess(es) 28. The spanner wrench includes an arm of a predetermined length so that when a person of average strength uses it to tighten the retaining nut 26, a proper range of torque is provided. This is important and is further described hereinafter.

A backshell 30 is then placed over the cable 12 with external backshell threads 32 facing toward the retaining nut 26. The external backshell threads 32 cooperate with the internal threads of the retaining nut 26 to secure the retaining nut 26 thereto, as is described further hereinafter.

The backshell 30 includes internal threads at an end opposite to where the external threads 32 are disposed. The internal threads of the backshell 30 face toward the first end 12*a* of the cable.

Figure 4:
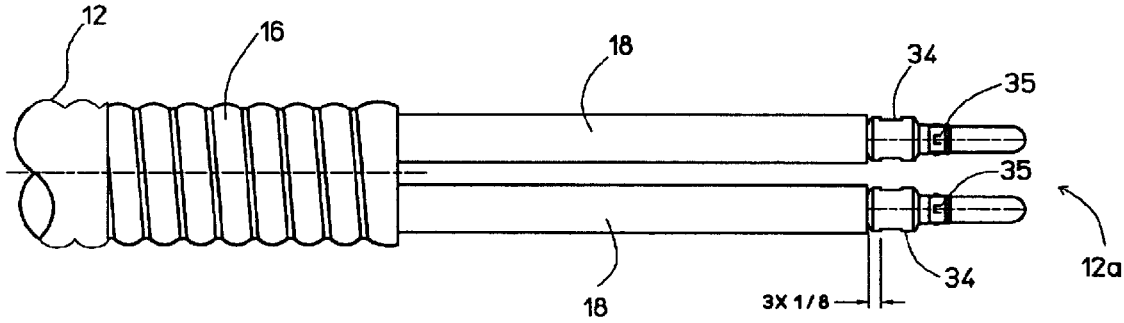
FIG. 4 is a plan view of the attachment of power contact pins to the cable.

Referring now in particular to FIG. 4 two of the three conductors 18 in the cable 12 are shown. The ground wire 20 is not shown. It is important to ensure that all of the conductors 18 are the same length.

Three power contact pins 34 are placed over the ends of the conductors 18 (where the insulation has been removed) and are crimped in place with an appropriate crimping tool, for example, a "P" die in a NICOPRESS™ tool. The crimp is located one-eight of an inch measuring from the end of each contact pin 34 that is disposed furthest away from the first end 12*a* of the cable.

The power contact pins 34 each include a plurality of locking flanges 35 that are disposed circumferentially around the body of each pin 34. The locking flanges 35 extend outward away from the body of each pin 34 at a taper (i.e., angle) that is closest to the pin 34 nearest the first end 12*a* of the cable. When the power contact pins 34 are later each inserted into a corresponding socket 44 (as is described hereinafter in further detail) the flanges 35 are compressed slightly and then they expand into recesses that are provided in the sockets 44, thereby locking each of the power contact pins 34 in position in each of the sockets 44 sufficient to prevent its removal by pulling in a reverse direction on the conductors 18. A positive click is heard three times, once for a successful engagement of each of the contact pins 34, and each click provides audible feedback that this has occurred.

The cold shrink tubing 22, retaining nut 26, and the backshell 30 are disposed over the cable 12 farther to the left (i.e., away from the first end 12*a*) and are not visible in this or several of the following FIGURES, until they are needed.

Figure 5:
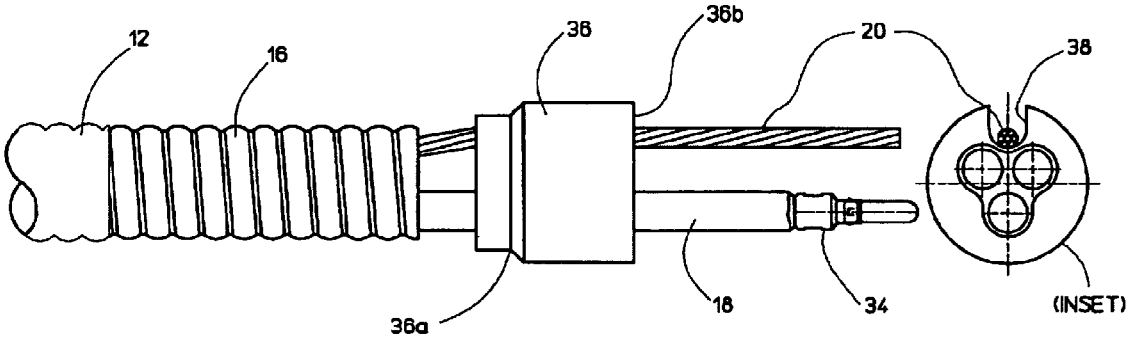
FIG. 5 is a plan view of a sealing grommet being urged over the cable end.

Referring now in particular to FIG. 5, a small quantity of translucent sealer is applied over each of the three conductors 18 to aid in installing a sealing grommet 36. The sealing grommet 36 is aligned with the conductors 18 so that there is one conductor 18 down and two conductors 18 up as shown in the inset in FIGURE. Only the lower (bottom) conductor 18 is shown in the FIGURE. A groove 38 is provided in the top of the sealing grommet 36. The ground wire 20 is disposed in the groove 38.

The sealing grommet 36 is then urged over the three conductors 18 and along the ground wire 20 away from the first end 12*a*. Each of the conductors 18 is splayed at a ten to fifteen degree angle (as shown) to assist in urging the sealing grommet 36 over the conductors 18.

The sealing grommet 36 is formed of an elastomer and is used to seal the connector 19 and also to insulate the conductors 18 and ground wire 20 from each other. As shown in the inset, three openings are provided in the sealing grommet 36 with each of the three opening accepting one of the conductors 18.

The sealing grommet 36 includes a tapered end 36*a* and a flat end 36*b*. The tapered end 36*a* is disposed toward the armor clad 16 and away from the first end 12*a*. The conductors 18 are then straightened so that they are parallel with respect to each other and to a longitudinal axis of the cable 12, as necessary, to assist in the next step.

Figure 6:
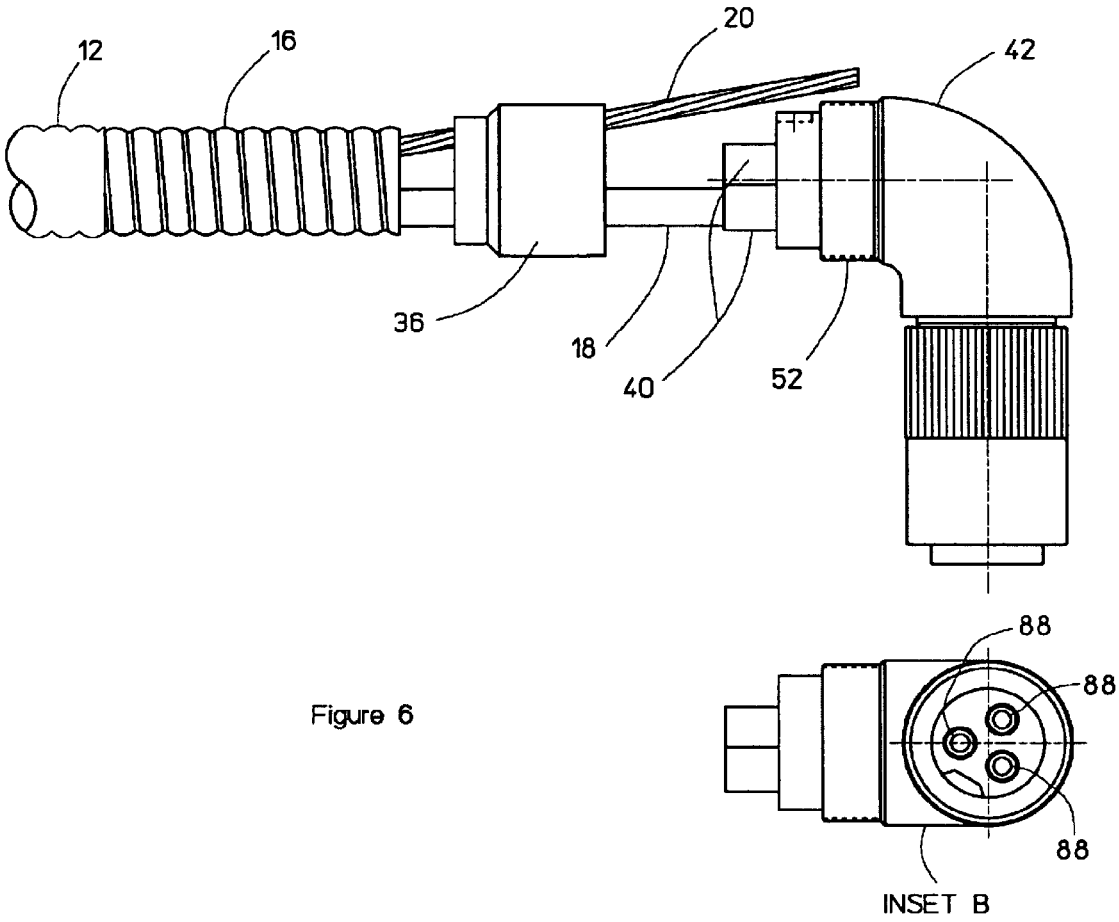
FIG. 6 is a plan view of a the power contact pins of FIG. 4 being inserted into sockets of a ninety degree housing.

Referring now in particular to FIG. 6, a thin coating of the translucent sealant is applied over the first inch of each of the conductors 18 to act as a lubricant. Each of the three power contact pins 34 is then inserted into a corresponding one of three contact boots 40.

The three contact boots 40 are attached to a first end of a ninety degree housing 42. The first end of the ninety degree housing 42 is proximate the first end 12*a* of the cable 12.

Each of the three contact boots 40 lead to one of the corresponding sockets 43 into which the power contact pins 34 mate and provide electrical continuity.

As mentioned hereinabove, when the conductors 18 are urged toward the ninety degree housing sufficient to cause each of the power contact pins 34 to pass through the contact boots 40 and into the corresponding sockets 43, the flanges 35 expand into retaining recesses provided in the corresponding sockets, thereby providing an audible click and positive engagement with the sockets 44.

The person doing the attachment will listen carefully for each of the three audible clicks, which may occur in rapid sequence to each other, as the contact pins 34 lock into place in the sockets 44.

Figure 7:
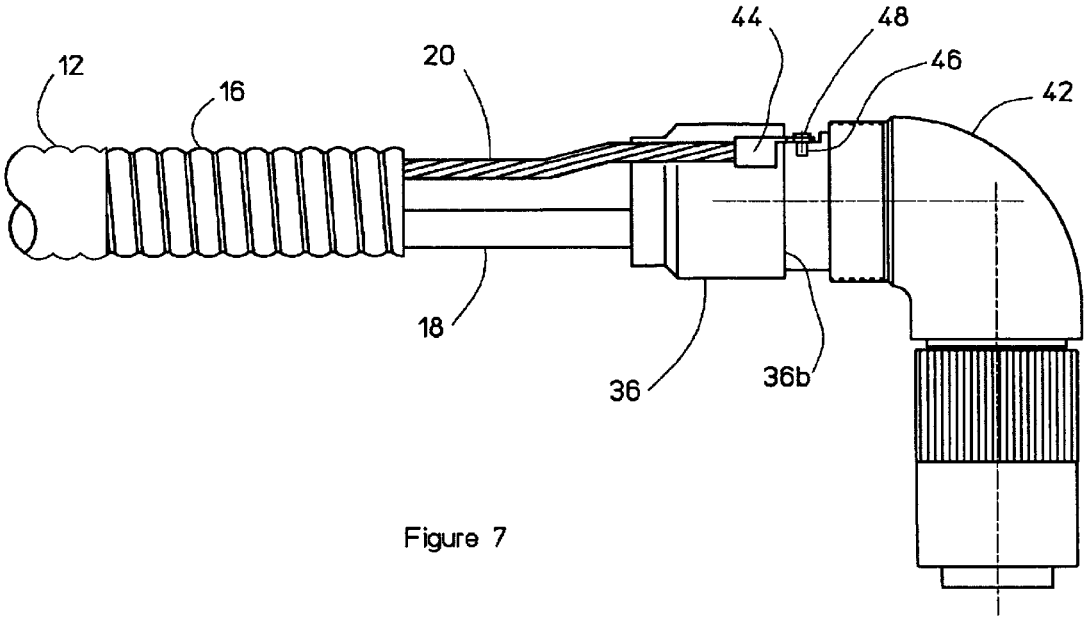
FIG. 7 is a plan view of the sealing grommet adjacent to the ninety degree housing and attachment of the ground wire.

Referring now in particular to FIG. 7, a thin coating of the translucent sealant is applied over the length of each of the conductors 18 to act as a lubricant. The sealing grommet 36 is then urged toward the first end 12*a* until the flat end 36*b* of the sealing grommet 36 is flush against the first end of the ninety degree housing 42.

The three contact boots 40 are each disposed in one of the three openings that are provided in the sealing grommet 36 when the sealing grommet 36 is disposed flush against the ninety degree housing 42.

Any remaining excess of the translucent sealant is removed (i.e., wiped) from the conductors 18.

The ground wire 20 is then positioned so that it is disposed above and between the top two conductors 18 (not shown in FIGURE for clarity) and in the groove 38 of the sealing grommet 36.

A terminal ring 44 is positioned with a terminal ring opening above a threaded hole 46 in the ninety degree housing 42. The ground wire 20 is then placed adjacent to a crimp bucket (i.e., a cylindrical portion) of the terminal ring 44. The ground wire 20 is then cut so that it length does not exceed the end of the crimp bucket that is closest to the threaded hole 46.

The terminal ring 44 is then crimped onto the ground wire 20 which may include, for example, a 4AWG wire size or it may include three strands of 8AWG wire size, with no 1 AWG power conductors in the cable 12. Another type of cable (not shown) includes no 2 AWG power conductors and it may include either one strand of 6 AWG or three strands of 10 AWG for the ground. If three strands of 8AWG wire size are used to form the ground wire 20, the three strands are formed so as to travel in parallel and meet in the crimp bucket where the terminal ring 44 is then crimped sufficient to secure them thereto after trimming the three strands to the proper length.

A flat head screw 48 is then used to secure the terminal ring 44 to the threaded hole 46 in the ninety degree housing 42.

Figure 8:
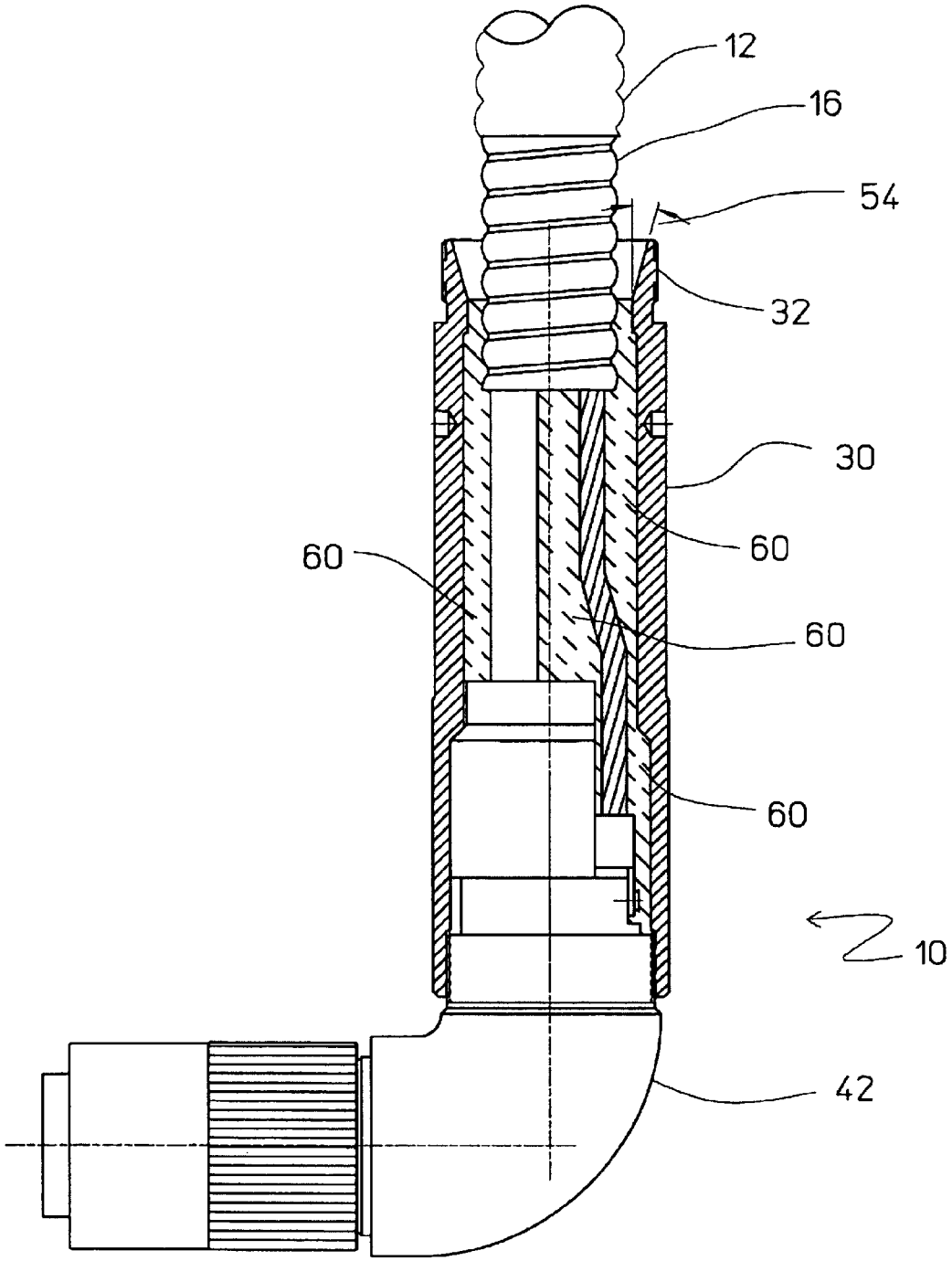
FIG. 8 is a cross sectional view of a backshell of FIG. 3 fastened to the ninety degree housing and filled with a first quantity of epoxy.

Referring now in particular to FIG. 8, a thin coating of the translucent sealant is applied over the outside circumference of the sealing grommet 36 to act as a lubricant.

The backshell 30 is then urged over the cable 12 toward the first end 12*a* which is also toward the ninety degree housing 42. The backshell 30 is then secured to the ninety degree housing 42 by inserting a protrusion of the spanner wrench into a backshell opening 50 (See FIG. 3) and turning it so that the internal threads of the backshell 30 cooperate with external threads 52 (See FIG. 6) that are machined in the first end of the ninety degree housing 42.

At an end of the backshell 30 that includes the external backshell threads 32 is included a taper 54 on an interior circumference of the backshell 30. The taper 54 includes a larger diameter at the end of the backshell 30 and tapers progressively at about a fifteen degree angle toward the interior of the backshell 30 (i.e., toward the first end 12*a*). The taper 54 is important and is described in greater detail hereinafter.

Figure 11:
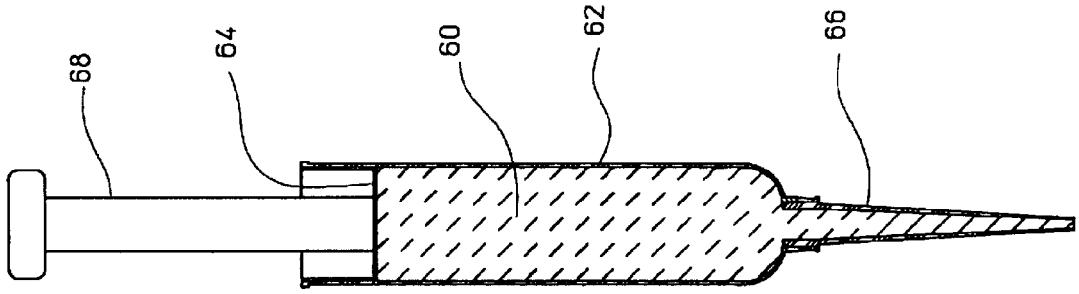
FIG. 11 is a side view of a two-part epoxy and dispenser.
Figure 11:
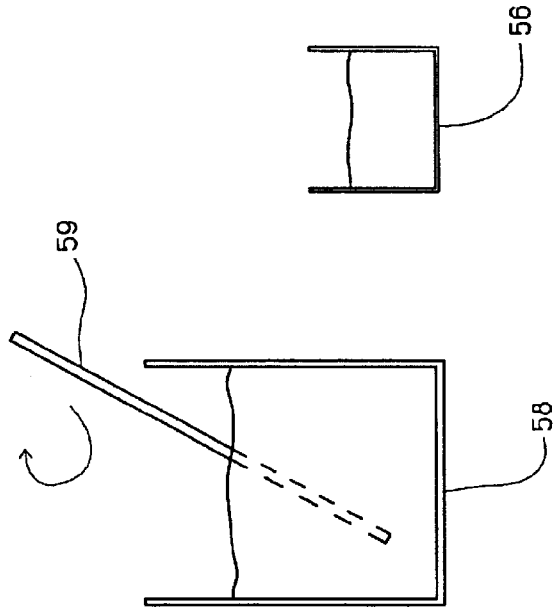

Referring now momentarily to FIG. 11, a hardener 56 is poured into a resin container 58 and is thoroughly mixed 59 to form an epoxy 60 that gels, preferably, in about forty-five minutes and becomes rigid in about two hours. The mixed epoxy 60 is then poured into a dispenser 62. A plunger 64 is placed in an end of the dispenser 62 away from a nose portion 66. The nose portion 66 is cut near the tip (back about three-quarters of an inch) to provide a small opening for the epoxy 60 to be discharged when the plunger 64 is forced into the dispenser 62 by the use of a convenient blunt instrument 68.

The quantity of the resin 58 and hardener 56 are known. As a result, when mixed, a resultant volume of the epoxy 60 that is produced is predetermined to fall within a given range.

Referring again to FIG. 8, the tip of the nose portion 66 of the dispenser 62 is inserted in the end of the backshell 30 just past the end of the taper 54. The plunger 64 is urged into the dispenser 62 by the blunt instrument 68 sufficient to discharge a first volume of the epoxy 60 into an interior of the backshell 30 that is sufficient to fill the backshell 30 with the epoxy 60 up to the smallest diameter of the taper 54 but not into the taper 54 at all, approximately five-eighths of an inch from the end of the backshell 30. The tip of the nose portion 66 of the dispenser 62 is then covered and the dispenser 62 is set aside for later use.

If the assembly has been correctly accomplished thus far, the first volume inside of the backshell 30 is known (i.e., it is determined by calculation) and accordingly, the first volume must fall within a predetermined range that makes provision for all tolerances.

The first volume of the epoxy 60 cures over time to provide an environmental and mechanical seal.

Figure 9:
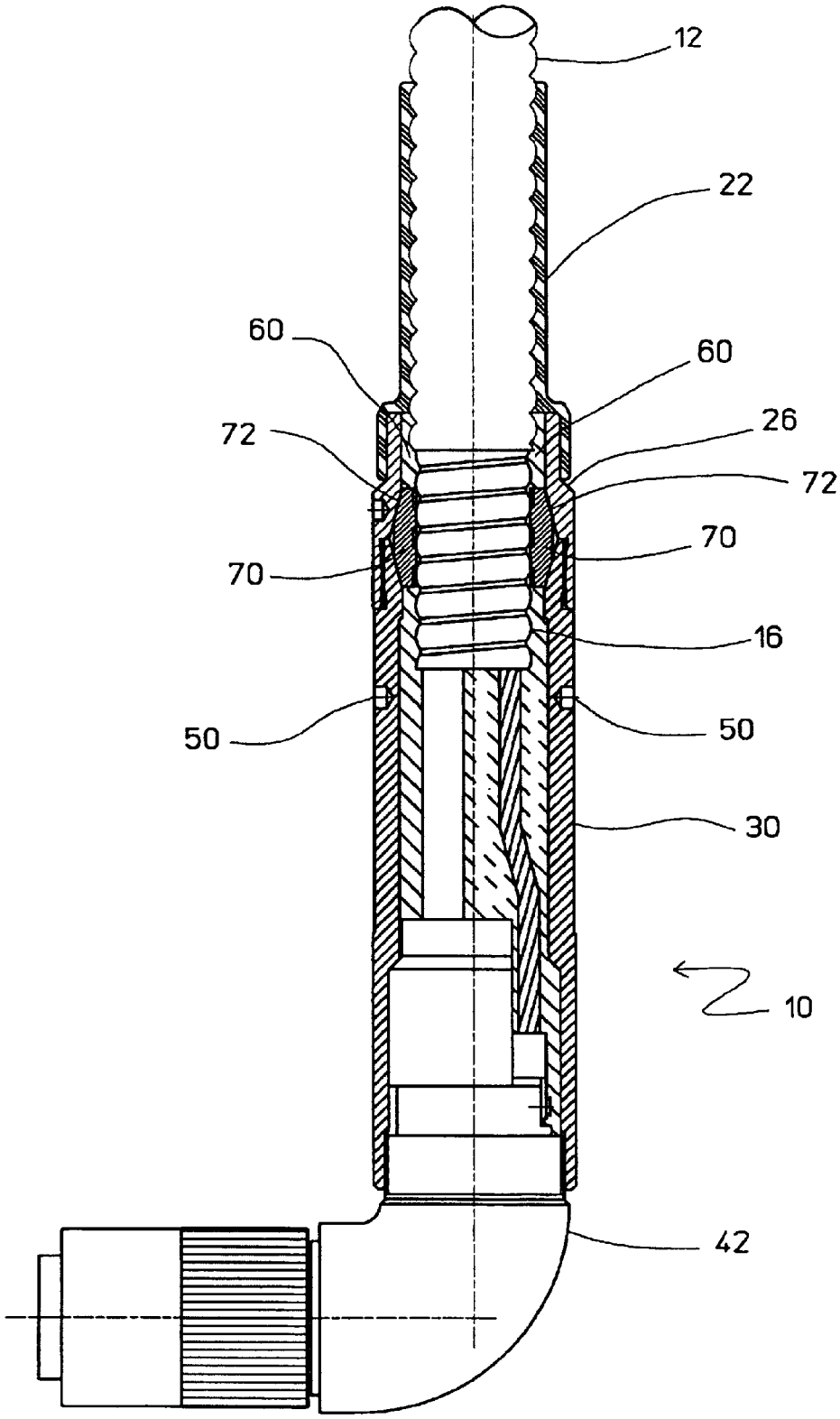
FIG. 9 is a cross sectional view of a split armor grip disposed over the cable, retaining nut, second quantity of epoxy, and shrink tube over a portion of the cable and nut.

Referring now in particular to FIG. 9, a pair of split-armor grips 70 are placed over the cable 12 and partially in the taper 54. The split armor grips 70 (See FIG. 10) include two identical halves that include matching machined angled surfaces on an outside diameter at both ends thereof that are designed to cooperate with the taper 54. It matters not which end of the grips 70 is inserted in the taper 54.

The two halves of the split armor grips 70, when held together so that a flat interior face of each half abuts the flat face of the other half, has an inside circumference that includes a plurality of machined parallel rings and recesses that form a series of longitudinal rings and recesses along the longitudinal length of the grips 70. The longitudinal rings and recesses are intended to bear down on the armor clad 16 of the cable 12, as is described hereinafter. The split armor grips 70, therefore, must have an interior diameter of the longitudinal rings and recesses that is less than an outside diameter of the armor clad 16 of the cable 12.

It is important that the split armor grips 70 be disposed over only the armor clad 16 and not over any of the cable jacket 14. If any portion of the cable jacket 14 appears to be disposed under any portion of the split armor grips 70, then that portion of the cable jacket 14 is cut and removed before proceeding.

The retaining nut 26 is then urged toward the first end 12*a* (toward the ninety degree housing 42) where its interior threads cooperate with the external threads 32 of the backshell 30. The spanner wrench is inserted into the recess 28 and the retaining nut 26 is tightened fully onto the backshell 30.

As the retaining nut 26 is tightened, a matching taper 72 in the retaining nut 26 cooperates with the taper of the split armor grip 70 as does the taper 54 of the backshell 30 sufficient to urge the two halves of the split armor grip 70 closer to each other.

When the retaining nut 26 is fully tightened, the longitudinal rings and recesses of the split armor grip 70 will "bite" down onto the armor clad 16 of the cable 12 sufficient to secure the connector 10 to the cable 12 while also ensuring that there is no way possible to "over tighten" the split armor grip 70 and possibly damage the armor clad 16 or any other part of the cable 12.

It is extremely important not to damage or rupture the armor clad 16 of the cable 12. If this were to occur, the resultant cable 12 and connector 10 would not comply with explosion proof requirements. Gases could leak out or ambient moisture and other substances could enter the interior of the cable 12.

As those who will be attaching the connector 10 in the field may not possess exceptional skill, it is desirable to provide a fail-safe mechanism that is certain to provide the necessary strain relief for the cable 12 and yet also ensure that the cable 12 cannot be damaged. Were this not achieved it would be impossible for field attachment of the connector 10 to the MC-HL cable 12.

In a manner as previously described, the dispenser 62 is similarly used to express a second volume of the epoxy 60 into an interior of the retaining nut 26 until the epoxy 60 is level with the end (top) of the retaining nut 26. It is helpful to position the connector 10 as shown prior to dispensing the first and second volumes of the epoxy 60 (FIGS. 8 and 9).

The cold shrink tubing 22 is then urged toward and slightly over a portion of the retaining nut 26 so that an end of the cold shrink tubing 22 that is disposed closest to the ninety degree housing 42 aligns with a lowest portion of an exterior shoulder of the retaining nut 26. The expanded core 24 is then pulled out toward the cable 12 which causes the tubing 22 to progressively compress first over the retaining nut 26 and then over a portion of the cable 12. This provides a neat appearance to the finished assembly.

Referring momentarily to FIG. 10, a label 74 is attached to the cable 12 using a pair of fasteners 76 that pass through holes in the label 74 and around the circumference of the cable 12. The label 74 provides whatever warnings and notifications are desired or required.

A lanyard 78 includes a first end 78*a* that has been placed around the cable 12 and secured back onto itself by a crimp fastener 80. A second opposite end of the lanyard 78 includes a crimped on ring 82 that is attached to a protective cap 83 (dashed lines) by a screw 84.

The total volume of epoxy 60 provided is sufficient to fill the first and second volumes. If there is not enough of the epoxy 60 to do so, that indicates that something, perhaps some component part, was omitted during field-attachment and that the procedure was not properly followed. In other words, the assembly is in error. This provides a clear visual indication of a fault in assembly and that the resultant cable 12 and connector 10 must not be used.

Similarly, if an excess of the epoxy 60 exists, this provides a clear visual indication that the procedure was not properly followed, for example, that something extra is disposed in the connector 10 or some other error occurred, again meaning that the finished assembly must not be used.

The remaining volume of the epoxy 60 must fall within a predetermined range to provide a visual indication that the assembly procedure for field attachment of the connector 10 to the cable 12 has been properly accomplished.

Not only does the instant invention prevent damage to the cable 12 during field attachment by less skilled personnel but it also provided visual confirmation of proper assembly procedures.

The epoxy 60 in the connector 10 is given two hours to set before use of the connector 10. The connector is then installed in accordance with standard A400-0147.

Referring again to FIG. 10, the finished product is shown with the field attachable, disconnectable electrical connector 10 attached to the cable 12 ready for use in accordance with explosion proof standards.

When examining a profile of the shape of the components used in the connector 10, for example the sealing grommet's 36 exterior, it is noted that straight lines over extended distances are generally avoided. Examination of the numerous interfaces between various component parts reveal that extended straight lines are avoided. This is to prevent creepage from occurring. It is possible for arcing to occur, even over the surface of a dielectric (such as the sealing grommet 36), when high voltages are involved. Ionization of gases, perhaps a trace of contaminants, or some other factor can result in creepage. The use of angled surfaces throughout the connector 10 greatly reduces the possibility of this occurring.

All of the details of the ninety degree housing 42 have not been shown as they are not necessary to an appreciation of the instant invention and because those benefiting from the instant disclosure will realize that modifications and variations are possible to suit particular requirements. Certain key elements, however, warrant further description.

The ninety degree housing 42 includes a plurality of power pins 86 that extend from the corresponding sockets 43 at the first end of the ninety degree housing 42 to connector sockets 88 that are disposed at an opposite end of the housing 42 and which provide electrical continuity between each corresponding socket 43 and each connector socket 88.

As such electrical continuity from each conductor 18, through each corresponding power contact pin 34, through each corresponding socket 43, through each corresponding power pin 86, and to each corresponding connector socket 88 is provided.

The housing 42 includes dielectric material intermediate each of the power pins 86.

Any of the component parts of the connector 10 are formed of any desired material in any desired way. The retaining nut 26, backshell 30, and housing 42 preferably are machined out of brass or any other preferred conductive material. Electrical ground is provided through the metallic casing of the connector 10 retaining ring 26, backshell 30, and housing 42 or an alternate ground path (connector-not shown) is provided in the connector 10. As such, when properly connected, any external part of the connector 10 is connected to the ground wire 20 and is properly terminated so that it is at ground potential.

The ninety degree housing 42, as described, includes many component parts that are assembled together to provide the completed housing 42 assembly. A few of those include a ring 90 that is attached to an interior of the housing 42 at one end and to a coupling nut 92 at an opposite end. The coupling nut 92 includes environmental seals 94, as desired, and is adapted to rotate about its longitudinal axis sufficient so that it, and therefore the connector 10, can be mechanically and electrically connected to the oil field wellhead.

When the connector 10 is not attached to the oil field wellhead, the protective cap 83 is secured to the coupling nut 92 by internal threads that are provided in the coupling nut 92 that cooperate with external threads that are provided on the protective cap 83. The protective cap 83 prevents damage to the connector sockets 88.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A field-attachable, disconnectable electrical connector for use with MC-HL cable, comprising:

(a) a housing, said housing including a first end and an opposite second end, said first end including a plurality of electrical conductors attached thereto and said second end adapted for connecting to a stationary electrical connector, and including an electrical continuity from said plurality of electrical conductors to said stationary electrical connector;

(b) means for providing an environmental seal intermediate said cable and said connector and wherein said means for providing an environmental seal includes a sealing grommet that is disposed over said plurality of electrical conductors and adjacent to said first end of said housing, and wherein said sealing grommet includes a groove on its peripheral surface that is adapted to permit at least one ground wire to pass through said groove, and wherein said ground wire includes means for electrical and mechanical connection to said first end of said housing; and (c) wherein said cable is secured to said connector.

2. The field-attachable, disconnectable electrical connector of claim 1 wherein said sealing grommet is disposed over said plurality of conductors and adjacent to said first end of said housing, and wherein said sealing grommet includes a groove therein that is adapted to permit at least one ground wire to pass through, said ground wire including means for electrical and mechanical connection to said first end of said housing and including a backshell, said backshell including a cylindrical shape and threads adapted to attach a first end of said backshell to said first end of said housing, and wherein said backshell includes an epoxy therein sufficient to fill a first void.

3. The field-attachable, disconnectable electrical connector of claim 1 including a retaining nut that is adapted to cooperate with portion of said housing sufficient to urge an armor grip to engage a predetermined amount with an armor cladding of said cable.

4. The field-attachable, disconnectable electrical connector of claim 1 including a backshell, said backshell including a cylindrical shape and threads adapted to attach a first end of said backshell to said first end of said housing, and wherein said backshell includes a second opposite end and wherein said second opposite end includes second threads, and including a retaining nut that is adapted to cooperate with said second threads sufficient to urge a pair of split armor grips to engage a predetermined amount with an armor cladding of said cable, each of said split armor grips including a substantially cylindrical shape with a first taper at a first end thereof and a second taper at a second end thereof, wherein when said retaining nut is tightened said first taper is urged into contact with a corresponding inner first taper of said backshell sufficient to urge a first end of each of said split armor grips closer toward a longitudinal axis of said cable and said second taper is urged into contact with a corresponding inner second taper of said retaining sufficient to urge an opposite end of said split armor grips closer toward a longitudinal axis of said cable and wherein each of said split armor grips includes means for engaging said armor cladding disposed on an interior surface thereof.

5. The field-attachable, disconnectable electrical connector of claim 1 including means for attaching a certification label thereto.

6. The field-attachable, disconnectable electrical connector of claim 1 wherein said sealing grommet is disposed over said plurality of conductors and adjacent to said first end of said housing, and wherein said sealing grommet includes a groove therein that is adapted to permit at least one ground wire to pass through, said ground wire including means for electrical and mechanical connection to said first end of said housing and including a backshell, said backshell including a cylindrical shape and threads adapted to attach a first end of said backshell to said first end of said housing, and wherein said backshell includes an epoxy therein sufficient to fill a first void and wherein said backshell includes a second opposite end and wherein said second opposite end includes second threads, and including a retaining nut that is adapted to cooperate with said second threads sufficient to urge a pair of split armor grips to engage a predetermined amount with an armor cladding of said cable, each of said split armor grips including a substantially cylindrical shape with a first taper at a first end thereof and a second taper at a second end thereof, wherein when said retaining nut is tightened said first taper is urged into contact with a corresponding inner first taper of said backshell sufficient to urge a first end of each of said split armor grips closer toward a longitudinal axis of said cable and said second taper is urged into contact with a corresponding inner second taper of said retaining sufficient to urge an opposite end of said split armor grips closer toward a longitudinal axis of said cable and wherein said retaining nut includes an epoxy therein intermediate said pair of split armor grips and an opposite end of said retaining nut sufficient to fill a second void.

7. The field-attachable, disconnectable electrical connector of claim 6 including a portion of cold shrink tubing disposed over a portion of said electrical connector and over a portion of said cable.

8. The field-attachable, disconnectable electrical connector of claim 1 wherein said housing includes a radius.

9. The field attachable, disconnectable electrical connector of claim 8 wherein said radius includes ninety degrees of arc.

10. The field-attachable, disconnectable electrical connector of claim 1 including a power contact pin that is crimped onto each of said plurality of electrical conductors of said cable and a corresponding socket in said first end of said housing, and wherein each of said power contact pins is adapted to connect to one of said corresponding sockets.

11. The field-attachable, disconnectable electrical connector of claim 10 including means for latching each of said power contact pins to each of said corresponding sockets sufficient to retain each of said power contact pins in each of said corresponding sockets.

12. The field-attachable, disconnectable electrical connector of claim 11 wherein said means for latching each of said power contact pins to each of said corresponding sockets includes a plurality of locking flanges that are disposed circumferentially around a body of each power contact pin and wherein said plurality of locking flanges are adapted to engage with an interior of each of said corresponding sockets.

13. The field-attachable, disconnectable electrical connector of claim 1 including a plurality of power pins disposed in said housing, and wherein each of said plurality of power pins is connected electrically at a first end to a portion of said plurality of electrical conductors thereto and wherein each of said plurality of power pins is connected electrically at a second end to a portion of said stationary electrical connector.

14. The field-attachable, disconnectable electrical connector of claim 13 wherein an insulation is provided intermediate each of said power pins and a casing of said housing.

15. The field-attachable, disconnectable electrical connector of claim 14 wherein said housing includes a ring that is attached to an interior of said housing and wherein an opposite end of said ring is attached to a coupling nut, and wherein said coupling nut is adapted to rotate about a center longitudinal axis and wherein said coupling nut includes threads adapted to cooperate with said stationary electrical connector.

16. The field-attachable, disconnectable electrical connector of claim 15 including means for sealing said ring with respect to said casing of said housing and said coupling nut with respect to said ring.

* * * * *